US006272701B1

(12) United States Patent
Zafiroglu

(10) Patent No.: US 6,272,701 B1
(45) Date of Patent: Aug. 14, 2001

(54) FITTED MATTRESS COVER WITH A SKIRT HAVING AN INTEGRAL ELASTIC EDGE

(75) Inventor: Dimitri Peter Zafiroglu, Wilmington, DE (US)

(73) Assignee: Xymid L.L.C., Petersburg, VA (US)

( * ) Notice: Subject to any disclaimer, the term of this patent is extended or adjusted under 35 U.S.C. 154(b) by 0 days.

(21) Appl. No.: 09/706,183

(22) Filed: Nov. 3, 2000

Related U.S. Application Data

(63) Continuation-in-part of application No. 09/275,763, filed on Mar. 24, 1999, now Pat. No. 6,199,231, which is a continuation-in-part of application No. 08/886,821, filed on Mar. 5, 1997, now abandoned.

(51) Int. Cl.[7] ..... A47G 9/00
(52) U.S. Cl. ..... 5/499; 5/497; 5/498
(58) Field of Search ..... 5/497, 498, 499, 5/482; 66/192, 196, 193; 112/475.01, 163, 252; 496/102, 98

(56) References Cited

U.S. PATENT DOCUMENTS

| | | | | |
|---|---|---|---|---|
| 2,942,280 | * | 6/1960 | May | 5/497 |
| 3,273,175 | | 9/1966 | Anderson et al. . | |
| 4,567,075 | * | 1/1986 | Krawczyk | 428/91 |
| 4,985,953 | | 1/1991 | Seago . | |
| 5,020,177 | * | 6/1991 | Etherington | 5/496 |
| 5,127,115 | * | 7/1992 | Williams et al. | 5/497 |
| 5,187,952 | | 2/1993 | Zafiroglu . | |
| 5,247,893 | | 9/1993 | Zafiroglu . | |
| 5,603,132 | | 2/1997 | Zafiroglu . | |
| 5,636,393 | | 6/1997 | Zafiroglu . | |
| 6,199,231 | * | 3/2001 | Zafiroglu | 5/497 |

* cited by examiner

*Primary Examiner*—Lynne H. Browne
*Assistant Examiner*—Fredrick Conley
(74) *Attorney, Agent, or Firm*—Lawrence Isakoff

(57) ABSTRACT

A fitted mattress cover is provided with a flat top panel and a knitted or woven fabric skirt attached to and depending from the periphery of the top panel. The lower edge of the skirt contains a band of longitudinally extending elastic yarns that were integrally incorporated into the edge during fabrication of the skirt fabric. The yarns of the elastic band provide sufficient tension to pull some of the skirt fabric under the mattress and provide a secure fit when the cover is installed on a mattress.

7 Claims, 1 Drawing Sheet

FITTED MATTRESS COVER WITH A SKIRT HAVING AN INTEGRAL ELASTIC EDGE

CROSS-REFERENCE TO RELATED APPLICATION

This is a continuation-in-part of pending application Ser. No. 09/275,763, filed Mar. 24, 1999 now U.S. Pat. No. 6,199,231, which is a continuation inpart of application Ser. No. 08/886,821, filed Mar. 5, 1997, now abandoned.

BACKGROUND OF THE INVENTION

1. Field of the Invention

This invention relates to a fitted mattress cover that has a woven or knitted skirt. More particularly, the invention concerns a process for making such a fitted mattress cover, wherein the woven or knitted skirt fabric has an edge comprising strong elastic yarns that are woven or knit integrally with the skirt fabric. The elastic yarns of the edge form a band that provides sufficient tension to pull the skirt material under the mattress when the mattress cover is fit onto a mattress.

2. Description of the Prior Art

Fitted mattress covers comprise a flat top panel of substantially inextensible material and a skirt that depends from the periphery of the top panel. In use, the top panel covers the top of surface of the mattress and the skirt covers the sides of the mattress. Mattresses to which the covers are fitted typically have a thickness in the range of about 7 to about 15 inches. As used herein, the term "longitudinal direction" refers to the direction that follows around the long dimension of the sides of a mattress and the term "transverse direction" refers to the direction that is perpendicular to the longitudinal direction and is parallel to the thickness dimension of the mattress.

Known fitted mattress covers have often included skirts that had specially constructed corners or an elastic tape attached to the bottom edge of the skirt, to help hold the fitted mattress cover in place. For example, May, U.S. Pat. No. 2,942,280, disclosed a fitted mattress cover having an inwardly sloping skirt made of a cotton fabric commonly used in undergarments, the end and side walls of the skirt being connected at each corner to form progressively tapered corners, and the bottom edge of one end wall containing an attached elastic tape. Other early fitted mattress covers were disclosed by Anderson et al, U.S. Pat. No. 3,237,175, column 1, lines 15–37, which disclosure is incorporated herein by reference. Anderson et al also disclosed elastic tapes enclosed within a folded and stitched entire bottom edge of the skirt of a fitted mattress cover.

Each of the early fitted mattress covers had skirts that lacked substantial elastic retractive power in the longitudinal direction of the skirt. As a result, the skirts seldom had a neat, snug fit on the mattress. Furthermore, the elastic tapes had to be manufactured separately and then sewn in or otherwise attached to the skirt edge.

To overcome some of these shortcomings, particularly the lack of longitudinal elastic retractive power, various fitted mattress covers having stretchable skirts of stitchbonded fabrics have been suggested. Some such stitchbonded fabric skirts have substantial elastic stretchability and retractive power in the longitudinal direction, as well as some stretchability in the transverse direction. Mattress covers with skirts having transverse stretchability accommodate the different thicknesses of commercial mattresses. For example, Williams et al, U.S. Pat. No. 5,127,115, discloses a mattress cover that has a stitchbonded fabric skirt that is stretchable in the longitudinal and transverse directions, and has an elastic band attached to the bottom edge of the skirt fabric Zafiroglu, the present inventor, in U.S. Pat. Nos. 5,187,952 and 5,247,893, discloses a fitted mattress cover having an elastic skirt formed from a stitchbonded fabric comprising a substantially nonbonded fibrous layer in which elastic yarns, such as spandex elastomeric yarns, are stitched to create lanes of different longitudinal stretchability and equal transverse stretchability. A heavy elastic band is attached to the bottom edge of the skirt fabric. Zafiroglu et al, U.S. Pat. No. 5,636,393, discloses another fitted mattress cover having another stitchbonded fabric skirt that has a greater stretchability in the transverse direction than in the longitudinal direction. Zafiroglu, U.S. Pat. No. 5,603,132, discloses still another fitted mattress cover having another stitchbonded skirt that does not have a banded appearance. Although fitted mattress covers with such stitchbonded fabric skirts have met with some success in the bedding market, further improvements are desired. The present inventor has found that some mattress covers made with skirts of stitchbonded fabrics that incorporate nonwoven layers of substantially non-bonded or non-entangled fibers, sometimes are prone to mechanical failure and to pilling, especially when the covers are laundered. The present inventor also found that mattress covers made with skirts of stitchbonded fabrics that incorporate nonwoven layers of strongly bonded or highly entangled fibers, though stronger and less prone to pilling, usually do not have sufficient flexibility or softness desired for the skirt fabric.

An aim of the present invention is to provide a fitted mattress cover having a skirt which can be fitted neatly and snugly onto mattresses of different thicknesses, can retain its desirable characteristics even after several launderings and does not suffer the shortcomings of mattress covers made with skirts of stitchbonded fabrics.

Another aim of the present invention is to provide an economical process for making a fitted mattress cover wherein the skirt fabric has an elastic edge formed integrally within the skirt during the knitting or weaving of the skirt.

SUMMARY OF THE INVENTION

The present invention provides a fitted mattress cover. The mattress cover has a top panel of an inextensible fabric for overlaying the top surface of a mattress and a skirt of a knit or woven fabric, attached to and depending from the periphery of the top panel, for covering the sides and ends of the mattress. The knit or woven skirt fabric has a lower edge and an upper edge running in a longitudinal direction parallel to the periphery of the panel. At least the lower edge has longitudinally extending elastic yarns knit or woven integrally with the skirt fabric. Typically, the elastic yarns form a band having a width of at least 2-millimeters, preferably in the range of 5 to 25 mm. Preferred elastic yarns include spandex yarns, elastomeric yarns and elastic combination yarns, most preferably elastic combination yarns of spandex air-jet entangled with textured filaments of nylon or polyester.

The present invention also provides a process for making the above-described fitted mattress cover. The process comprises the steps of forming the top panel; knitting or weaving the skirt fabric with elastic yarns integrally incorporated in and longitudinally extending about at least the lower edge of the skirt; and attaching the skirt fabric to the periphery of the top panel.

BRIEF DESCRIPTION OF THE DRAWINGS

The invention will be better understood by reference to the drawings wherein.

DETAILED DESCRIPTION OF PREFERRED EMBODIMENTS

For convenience and clarity, definitions will now be given of several terms that are used herein.

"Integral elastic edge" refers to the upper edge and/or lower edge of the skirt which edge extends in the longitudinal direction of the skirt and which is formed with elastic yarns that are knit or woven integrally at the edge of the main body of the skirt fabric during the knitting or weaving of the skirt.

"Elastic" refers to the property of a fiber, filament, yarn or fabric to stretch when under tension and then, when the tension is released, to retract quickly and forcibly to its original length.

"Spandex" is a manufactured elastic fiber-forming substance is a long chain synthetic polymer that is comprised of at least 85% by weight segmented polyurethane. Typically, yarns of spandex are capable of elastic stretch of at least 300%, and often over 600%. Such yarns exert significant retractive force when in a stretched condition.

A "bulked yarn" is yarn that has been treated to have a notably greater apparent volume or bulk and still have sufficient stability to withstand yarn processing tensions and the normal forces exerted on garments during wear.

A "stretch yarn" is a yarn made from thermoplastic filaments (e.g., of nylon or polyester) which has been treated so that the yarn is capable of a pronounced degree of stretch and rapid recovery. In contrast, conventional drawn thermoplastic yarns, which typically have an elastic stretch of less than about 15% and a break at an elongation of less than 35%, are considered herein to be non-elastic.

An "elastic combination yarn" is a yarn that has at least two dissimilar yarn components. Typically, one component is an elastic yarn (e.g., LYCRA® spandex, manufactured by E. I. du Pont de Nemours & Co.), and another component is a conventional or textured yarn of natural or synthetic fiber. An elastic combination yarn also can be a bulked yarn.

Conventional warp-knitting and weaving nomenclature are used to identify the various patterns employed in making a skirt fabric of the present invention. An underlap is the portion of a stitch that forms when a knitting machine shogs over the needle spaces of the knitting machine and connects successive wales and in the knit fabric of the skirt is referred to herein as a "float".

Figure 1:
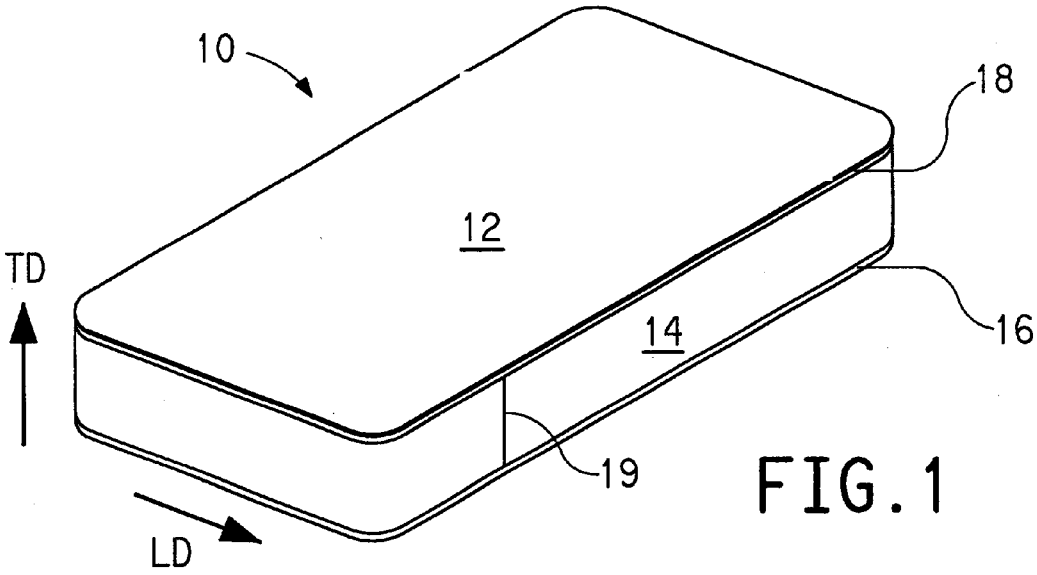
FIG. 1 is an isometric view of mattress cover 10 of the present invention having a flat top panel 12, a knitted or woven fabric skirt 14 attached to and depending from the top panel, the skirt having a lower edge 16, an upper edge 18 and a seam 19

Preferred embodiments of the invention will now be described with reference to the drawings. FIG. 1 shows a mattress cover 10 which comprises a top panel 12 and a skirt 14. Top panel 12, preferably is a quilted padding material which optionally may include a water impermeable layer. Typically, top panel 12 is substantially inextensible and has dimensions which correspond approximately to the dimensions of the top of the mattress that is to be covered. Skirt 14 is a knitted or woven fabric that preferably has a some elastic stretch in the longitudinal direction (i.e., about 5–20% but most preferably, at least 50%). Skirt 14 also comprises upper edge 18 and lower edge 16. Elastic yarns are incorporated integrally into lower edge 16 and optionally upper edge 18 during the knitting or weaving of the skirt fabric. Elastic yarns in lower edge 16 serve to pull the bottom portion of skirt 14 underneath the mattress on which the cover is fitted. Elastic yarns in upper edge 18 reinforce the top edge of the mattress cover and provides a location for attaching (usually by sewing) skirt 14 to top panel 12.

Skirt 14 may be knit with a conventional single-bar or multiple-bar warp-knitting machine, that typically forms 5 to 40 courses per inch (2 to 16 per cm) and 15 to 60 wales per inch (6 to 24 per cm). Typically, the warp-knitting machine is threaded with non-elastic yarns (e.g., bulked yarns) along its entire knitting width, except at locations intended for edges 16 and 18, wherein elastic yarns are employed. In a similar fashion, all yarns used in a loom for weaving the skirt fabric are nonelastic, except that elastic yarns are used in warps intended for edges 16 and 18. The elastic yarns help the skirt of the mattress cover fit snugly around the sides and ends of the mattress. Bulked yarns add desirable cover (i.e., opacity) to the skirt fabric.

Typical knitted or woven skirt fabrics of the invention before removal from the knitting or weaving machine and subsequent contraction, have a unit weight in the range of 30 to 200 grams/square meter. After removal from the machine, the skirt fabric, in a relaxed contracted condition, can weigh considerably more than in the non-contracted condition, sometimes more than twice as much.

The knitted or woven fabric employed to form the skirt of the fitted mattress cover of the invention has a uniform, smooth surface. If non-elastic yarns are used in the skirt fabric, except at the skirt edges, the skirt fabric typically has a stretchability of 5 to 20%. However, the lower elastic edge of the skirt fabric can stretch at least 50% from its relaxed length. Preferably, the longitudinal elastic stretch of the lower edge is in the range of 75 to 150%. The method by which the elastic, inelastic and total stretches in the longitudinal and transverse directions are measured is described hereinafter.

A preferred mattress cover of the invention is fabricated with a knitted skirt by a process that comprises the following steps:

(a) A flat top panel is formed from a substantially inextensible fabric. The panel has a peripheral edge. Typically, the top panel is formed by quilt stitching two layers of material with a filling material between the two layers and then cutting the quilt-stitched material to correspond in size to the top of the mattress to which the cover is to be fitted.

Figure 2:
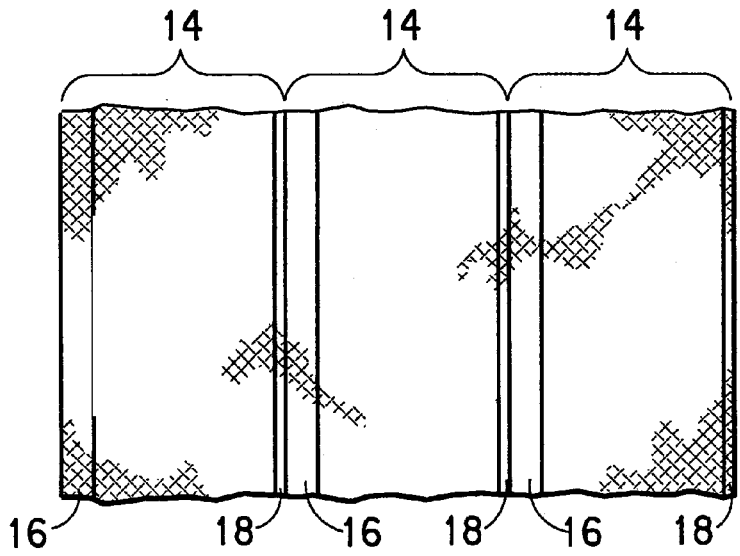
FIG. 2 is an idealized plan view of three lengths of knitted or woven skirt fabric 14, having lower edge 16 and upper edge 18, having been fabricated simultaneously side by side on a warp-knitting machine or on a loom.

(b) A skirt fabric is knit with non-elastic yarns and elastic yarns threaded on one or more bars of a warp-knitting machine. The skirt fabric is knit with upper and lower longitudinal edges in which elastic yarns are integrally knit. During the knitting, the non-elastic yarns and the elastic yarns are tensioned sufficiently to maintain the yarns in a substantially taut condition so that during the knitting, the tensioned yarns behave substantially like "hard" yarns (i.e., like non-stretch conventional drawn yarns of nylon or polyester). As a result of the knitting in this manner, the yarns have a "residual stretch" in the range of about 5 to 20%, as calculated from the actual length of yarn fed and the theoretical length of the stitches knit therefrom. The yarns are knit into repeating patterns of stitches having wales and courses. In a further preferred skirt fabric, successive courses are separated by a distance, $d_c$, of at least 1.25 millimeters and the stitch pattern that has the longest floats also has the longest distance, $d_w$, between successive wales, but distance $d_w$ is never larger than the distance, $d_c$, between courses. A suitable warp-knitting machine for this step is a 15-to-60-gage tricot or a Raschel knitting machine capable of knitting 5 to 20 courses per inch (2 to 8/cm) and 15 to 60 wales per inch (6 to 24/cm). Because typical knitting machines are several meters wide, several skirts can be formed simultaneously on the machine, as illustrated in FIG. 2. The stitch patterns in the upper and lower edges of the skirt can be arranged so that no longitudinal cutting of the knit fabric is necessary to separate the multiple skirts that are formed simultaneously on the knitting machine.

(c) The thusly knit skirt fabric is removed from the knitting machine and allowed to contract in a direction parallel to the longitudinal edges of the skirt. The edge of the skirt can contract to a length that is as small as one-third its non-contracted as-knit length (prior to removal from the knitting machine). The contraction occurs as a result of the release of the yarn tension that was applied during knitting and the further contraction that occurs when the fabric is washed and dried.

(d) Tension is applied to at least the upper longitudinal edge of the skirt fabric to stretch the upper longitudinal edge. While under such tension, the upper edge of the skirt is attached to the peripheral edge of the top panel. The length of the skirt fabric while so stretched is equal to the peripheral length of the top panel, but the amount of tension that is applied during the attachment is such that the main body of the skirt still can be stretched longitudinally another 5 to 20%. To complete the cover, the ends of the skirt fabric are usually sewn together at seam 19, as indicated in FIG. 1.

Test Methods

In the preceding description and in the Examples below, various fabrication parameters and certain stretch characteristics are given for the yarns and the knitted or woven skirts of the fitted mattress cover of the invention. The methods used to determine these parameters and characteristics are described in this section.

In knitting or weaving a skirt fabric, non-elastic and elastic yarns are fed under tension in an extended, taut condition to a fabric-forming machine. As the yarns are formed into fabric, some relaxation of the yarn tension and stretch occurs. For a knitted skirt fabric, the amount of stretch relaxation is determined by comparing the measured length, $L_a$, of tensioned yarn fed to each needle of the knitting machine in order to knit a given number of courses with the theoretical length, $L_t$, of yarn needed to follow the linear path of the needle movements used to create the particular stitches. The actual length fed is always greater than the theoretical length. The percent stretch relaxation, % RS, is then calculated by the formula % RS=100 $(L_a-L_t)/L_a$.

The "Pattern Ratio", P, in a knitted skirt fabric is defined as the ratio of the distance between successive courses, $d_c$, to the distance between successive wales, $d_w$, in the repeating stitch pattern having the longest floats. $P=d_c/d_w$. To illustrate the calculation of P, refer to Example 1 below, wherein the knitting patterns which have the longest floats are formed by 1-0, 2-3 (or 2-3, 1-0). The knitting machine makes 7 courses per 25 mm. Accordingly $d_c$=25/7 or 3.6 mm. The gage of the machine is 20 (i.e., 20 guides per 25 mm). Because the floats of the particular tricot stitches of this example connect wales that are separated by two needle spaces, there are 10 wales per 25 mm within the pattern. Thus, $d_w$=25/10 or 2.5 mm, and P=1.43.

When a knitted skirt fabric is removed from the knitting machine, the fabric may contract in both the longitudinal and transverse directions. The contraction ratio, C, in a given direction, is defined as the ratio of the as-knit (i.e., on the machine) length, $z_k$, of the fabric in that direction, to the length, $z_o$, of the fabric in that direction after it has been removed from the machine, washed and dried; thus, $C=z_k/z_o$.

All the stretch parameters recorded herein for skirt fabric are measured on samples that were first subjected to a C-wash-and-dry cycle in home-laundry equipment and then allowed to relax for 24 hours at room conditions (i.e., in air at about 25° C. and 50% relative humidity). To obtain samples for measuring the elastic and inelastic stretch characteristics of the skirt, longitudinal strips and transverse strips, each measuring measure 1-inch (2.5-cm) wide by 8-inches (20-cm) long, are cut from the skirt fabric. A standard length of 2.5 cm, parallel to the long edge of the strip, is marked near the middle of the strip. The strip is clamped at opposite ends of a 5-cm length of the strip, with the initially marked 2.5-cm length centrally located between the clamps. The strip is then subjected to tension by suspending a 10-pound (4.54 kg) weight from the lower clamp. The load elongates the strip of skirt fabric and simulates the amount of pull that typically is exerted on skirt material when as part of a mattress cover it is fitted onto a mattress. The extended length, $L_w$, of the original 2.5-cm mark (with the weight in place) is measured and the total stretchability (elastic and inelastic), % S, in a given direction is calculated as a percentage of original length by the formula % S=100 $(L_w-2.5)/2.5$. Part of the total stretch is inelastic and part is elastic. The percent inelastic stretch, % IS, is measured by removing the weight from the sample and after two minutes re-measuring the length, $L_o$, of the original 2.5-cm mark. The percent inelastic stretch is then calculated by the formula % IS=100$(L_o-2.5)/2.5$. Percent elastic stretch, % ES, is calculated by the formula: % ES=100(Lw−Lo)/2.5, or % ES=(% S−% IS).

EXAMPLES

The following examples further illustrate the invention with the manufacture of fitted mattress covers of the invention. In each of examples 1, 2 and 3, a three-bar skirt fabric is prepared with a 20-gage LIBA warp-knitting machine. The skirts of Examples 1 and 2 have high stretchabilities. Further fabrication details and stretch characteristics of the resultant skirt fabric from Examples 1 and 2 are given in the table following these two examples. The skirt of Example 3 is a relatively less elastic. In Example 4, skirt fabric is prepared by weaving. In each example, the skirt fabric, after being removed from the knitting or weaving machine, is subjected to a C-wash and drying in a relaxed condition. The upper edge of the dried fabric is stretched and attached to a top panel to complete a mattress pad cover. Each skirt has elastic yarn integrally knit or woven into its lower edge.

To complete the fabrication of a fitted mattress cover 10 with each of the skirts of the examples, a 16.5-foot (4.88-meter) long, 14-inch (0.36-meter) wide skirt fabric 14 is placed under a tension at its upper edge 18. The tension is adjusted to longitudinally stretch the skirt fabric to a length that is about 20% less than the measured total % S in that direction for the skirt fabric. While so stretched, the upper edge of the skirt fabric is attached by sewing to a top panel 12. The ends of the skirt fabric are then sewn together at seam 19 to complete the mattress cover. The mattress cover is intended for a queen-size mattress that measures about 78-inches (1.9-m) long, 60-inches (1.52-m) wide and 9-inches (0.23-m) thick.

Each of the above-described mattress covers is installed on a queen sized mattress. The longitudinal elastic retractive forces at the edges and within the skirt cause the skirt to fit smoothly, snugly and neatly around the sides and ends of the mattress. After removal from the mattress, the covers are subjected to ten C-wash-and-dry cycles in a home laundry and dryer. The covers are then replaced on mattresses. The covers again are installed easily and fit neatly and snugly around the side and ends of the mattress.

Example 1

A 2.0-oz/yd$^2$ (68-g/m$^2$) three-bar fabric is knit with 7 courses per inch (2.8/cm) with each 20-gage guide bar threaded, as follows. The back and middle bars are each fully threaded with bulked yarn of textured 70-denier (78-dtex) 34-filament polyester and respectively form 1-0, 2-3 and 2-3, 1-0 tricot stitches. The front bar is threaded with elastic combination yarn of 140-denier (156-dtex) LYCRA® spandex air-jet-entangled with 40-den (44-dtex) 34-filament textured nylon yarn, and forms 1-0, 0-1 chain stitches. The front bar threading sequence is 2 guides full and 8 guides empty, which sequence is repeated for 14 inches (35.6 cm) across the bar, and then two yarns per guide for 8 guides. The chain-stitched spandex-containing lanes, which are repeated every 14 inches 35.6 cm) provide the elastic edges of the skirt.

Example 2

A 1.9-oz/yd$^2$ (64-g/m$^2$) three-bar fabric is knit with 14 courses per inch (5.5/cm) with each 20-gage guide bar threaded, as follows. The back and middle bars are each fully threaded with the same bulked polyester yarn as in Example 4 and respectively form 1-0, 1-2 and 1-2, 1-0 tricot stitches. The front bar is threaded with elastic combination yarn of 140-denier (156-dtex) LYCRA® spandex air-jet-entangled with textured 70-denier (77-dtex) 34-filament polyester yarn, and forms 1-0, 0-1 chain stitches. The front bar threading sequence is the same as in Example 1 and provides the elastic edges of the skirt. Additional details are given in the table below.

TABLE

Knit Skirt Fabrication and Characteristics

| Example No | 1 | 2 |
|---|---|---|
| Gage (guides/25 mm) | 20 | 20 |
| Courses/25 mm | 7 | 14 |
| Back Bar Yarn % RS | 20 | 15 |
| Middle Bar Yarn % RS | 10 | 10 |
| Front Bar Yarn % RS | 10 | 10 |
| Course Spacing, $d_c$, mm | 3.6 | 1.8 |
| Pattern ratio, P, $d_c/d_w$ | 1.43 | 1.43 |
| As-knit unit weight, g/m$^2$ | 68 | 64 |
| Contraction Ratio, C | | |
| Longitudinal, LD | 2.5 | 2.8 |
| Transverse, TD | 1.1 | 1.1 |
| Fabric Stretch, | | |
| LD Total % S | 163 | 180 |
| LD Elastic, % ES | 161 | 130 |
| LD Inelastic, % IS | 2 | 50 |
| TD Total, % S | 195 | 210 |
| TD Elastic, % ES | 131 | 52 |
| TD Inelastic, % IS | 64 | 158 |

Example 3

A satisfactory three-bar skirt fabric is knit with 18 courses per inch (7.1/cm) with each 20-gage guide bar threaded, as follows, The back and front bars are each fully threaded with the same bulked polyester yarn as in Example 1 and form repeating patterns of opposed tricot stitches (i.e., 1-0, 1-2 stitches on the back bar and 1-2, 1-0 stitches on the front bar). The middle bar is threaded with the same elastic combination yarn as in Example 1 and forms a repeating pattern of closed chain stitches. The middle bar threading sequence is nine consecutive guides threaded with three elastic combination yarns per guide followed by empty guides for 14 inches (35.6 cm) across the middle bar. The central portion of the skirt has somewhat limited stretch (i.e., less than 20%) but the edge of the skirt containing the elastic combination yarns has a high longitudinal elastic stretch of at least 100%.

Example 4

A plain weave of 50 by 50 per inch skirt fabric is woven on a conventional loom with 20-count singles of 50% cotton and 50% polyester spun yarns. Every 14 inches (36.6 cm) of warp width, elastic combination yarns of 70-denier (78-dtex) LYCRA® spandex air-jet-entangled with 40-den (44-dtex) 34-filament textured nylon yarn] are employed for 20 consecutive warp counts thereby forming a 0.4-inch (1-cm) wide band of elastic combination yarns in the fabric. As the fabric is removed from the loom, the fabric is slit parallel to the warp along the line between the cotton/polyester yarns and the elastic combination yarns. This provides the skirt fabric with a 0.4-inches (1-cm) wide lower edge with integrally woven elastic yarns. For this sample of woven skirt fabric, the non-elastic upper edge of the fabric is attached to the periphery of a quilted top panel to form a completed mattress cover. The elastic band at the lower edge of the woven skirt fabric which has a % stretch of about 100% provides a secure fit of the mattress cover over a mattress on which it is installed.

Instead of slitting the above described woven fabric as in the preceding paragraph, the woven fabric on being removed from the loom, is slit parallel to the warp along the line that is located within the band of elastic yarns so that a lower elastic edge of 0.3-inch (0.8-cm) width, and an upper elastic edge of 0.1-inch (0.25-cm) width are formed. The upper elastic edge facilitates attachment of the woven skirt fabric to the top panel to form a satisfactory fitted mattress cover and the lower elastic edge provides a secure fit of the cover over a mattress on which it is installed.

Satisfactory fitted mattress covers are also provided when the portion of the skirt fabric that is woven with 20 singles cotton/polyester yarns is woven instead with 150-denier (167-dtex), 68 filament textured nylon yarn.

I claim:

1. A fitted mattress cover comprising:

a flat top panel of substantially inextensible fabric for overlaying the top surface of a mattress; and a skirt attached to and depending from a periphery of the top panel, wherein the skirt is a knit fabric having yarns that form courses and wales or a woven fabric having yarns that form warps and wefts, the successive courses or wefts extending in a transverse direction perpendicular to the periphery of the top panel the wales or warps extending in a longitudinal direction parallel to the periphery of the top panel, and the skirt further having a top edge and a lower edge, at least the lower edge comprising elastic yarns integrally incorporated therein and extending in the longitudinal direction.

2. A fitted mattress cover in accordance with claim 1 wherein the longitudinally extending elastic yarns integrally incorporated in at least the bottom edge of the skirt fabric are spandex yarns, elastomeric yarns, textured yarns or elastic combination yarns, and forms a band of at least 2-millimeters width.

3. A fitted mattress cover in accordance with claim 2 wherein width of the band of elastic yarns in the bottom edge is in the range of 5 to 35 millimeters.

4. A fitted mattress cover in accordance with claim 1 wherein the elastic combination yarn is of spandex air-jet entangled with textured filaments of nylon or polyester.

5. A fitted mattress cover in accordance with claim 1, wherein the lower edge of the skirt has an elastic stretch in the longitudinal direction of at least 50%.

6. A fitted mattress cover in accordance with claim 5 wherein the elastic stretch in the longitudinal direction is in the range of 75 to 150%.

7. A process for preparing a fitted mattress cover comprising the steps of forming a flat top panel of substantially inextensible fabric, the panel having a peripheral edge;

knitting or weaving a skirt fabric with upper and lower longitudinal edges, at least the lower edge comprising elastic yarns longitudinally extending and integrally incorporated therein, applying sufficient tension to at least the upper longitudinal edge of the skirt fabric so that the upper longitudinal edge is stretched to within 5 to 20% of the total longitudinal % stretch that the skirt fabric can reach; and attaching the thusly stretched upper longitudinal edge of the skirt fabric while under the tension to the peripheral edge of the top panel.

* * * * *